US005653355A

United States Patent [19]

Tominaga et al.

[11] Patent Number: 5,653,355

[45] Date of Patent: Aug. 5, 1997

[54] ANTI-IMPACT EASILY OPENED CAN LID

[75] Inventors: Shinya Tominaga, Yokohama; Joji Ito, Tokyo, both of Japan

[73] Assignee: Toyo Seikan Kaisha, Ltd., Tokyo, Japan

[21] Appl. No.: 534,060

[22] Filed: Sep. 26, 1995

Related U.S. Application Data

[63] Continuation of Ser. No. 62,143, May 17, 1993, abandoned, which is a continuation of Ser. No. 798,083, Nov. 27, 1991, abandoned .

[30] Foreign Application Priority Data

Nov. 28, 1990 [JP] Japan ..... 2-322366
Nov. 28, 1990 [JP] Japan ..... 2-322367

[51] Int. Cl.[6] ..... B65D 17/34

[52] U.S. Cl. ..... 220/269; 220/270; 220/272

[58] Field of Search ..... 220/265, 266, 220/268, 269, 270, 272, 273

[56] References Cited

U.S. PATENT DOCUMENTS

| | | | |
|---|---|---|---|
| 3,957,172 | 5/1976 | Hasegawa | 220/273 X |
| 3,967,752 | 7/1976 | Cudzik | 220/269 |
| 4,024,981 | 5/1977 | Brown . | |
| 4,148,410 | 4/1979 | Brown | 220/269 |
| 4,150,765 | 4/1979 | Mazurek | 220/269 |
| 4,276,993 | 7/1981 | Hasegawa | 220/269 |
| 4,286,728 | 9/1981 | Fraze et al. | 220/270 |
| 4,318,493 | 3/1982 | Jacobsen et al. | 220/269 X |
| 4,465,204 | 8/1984 | Kaminski et al. | 220/269 |
| 4,524,879 | 6/1985 | Fundom et al. . | |
| 4,681,238 | 7/1987 | Sanchez | 220/260 |
| 4,821,912 | 4/1989 | Wells | 220/231 |
| 4,930,658 | 6/1990 | McEldowney | 220/269 |
| 5,007,554 | 4/1991 | Hannon et al. | 220/269 |
| 5,064,087 | 11/1991 | Koch | 220/269 |
| 5,129,541 | 7/1992 | Vuigt et al. | 220/269 |
| 5,385,254 | 1/1995 | Hannon | 220/269 |

FOREIGN PATENT DOCUMENTS

| | | |
|---|---|---|
| 48122/85 | 4/1986 | Australia . |
| 0432659 | 6/1991 | European Pat. Off. . |

*Primary Examiner*—Allan N. Shoap
*Assistant Examiner*—Robin A. Hylton
*Attorney, Agent, or Firm*—Beveridge, DeGrandi, Weilacher & Young

[57] ABSTRACT

A can lid for a can, including a top plate to which a tab having a tab nose is coupled by a rivet at the substantial center thereof, a tab nose recess formed in the top plate underneath the tab nose and having a smooth bottom surface with no step part, and a score formed in the top plate surrounding around the tab nose recess and having a start point and an end point located in front of the rivet and defining therebetween a hinge space.

9 Claims, 5 Drawing Sheets

ANTI-IMPACT EASILY OPENED CAN LID

This application is a continuation of application Ser. No. 08/062,143, filed May, 17, 1993, now abandoned, which is a continuation of application Ser. No. 07/798,083, filed Nov. 27, 1991, now abandoned, these two earlier applications of which are entirely incorporated herein by reference.

BACKGROUND OF THE INVENTION

The present invention relates to an easy-open can lid for a container, and in particular, to an easy open can lid which is of the pull-open type having an opening piece adapted to be easily pushed down by the front end of a tab so as to have a push-open type function.

DESCRIPTION OF THE RELATED ART

Recently, there have been presented various kinds of the so called easy-open can lids incorporated with a pull tab or the like by which the can lid can be easily opened, such as a pull-open type lid having an opening piece which is pulled up and removed from the lid so as to form an opening; a lid of the type in which an opening piece forms an opening on the lid without being completely removed from the lid, remaining a part thereof connected to the top lid plate of a can; a push-open type lid having an opening piece which is pushed into a container, and the like.

In general, many pull-open type can lids with a tab have been used as can lids for easy-open containers.

However, most of them are of the type in which an opening piece for forming an opening is completely removed from the top plate of a can so that the opening piece having a sharp end edge is thrown away, causing a risk of infliction of a wound upon a human leg, hand or the like. Accordingly, a can lid of the type having an opening piece which incorporates a part that is maintained to be connected to the top plate of a can so as to prevent the opening piece from being completely removed from the top lid plate of the can, has been proposed.

However, with the pull-open type can lid, when the contents are drunk directly from a can such as a liquid beverage container, the opening piece having a sharp broken end edge is positioned facing the tip of the drinker's nose, inevitably causing an uncomfortable feeling so as to be undesirable for the user.

Further, with the push-open type lid, although no risk of positioning an opening piece facing the tip of the drinker's nose is present, the opening piece can be pushed in by a human finger so as to be dangerous. Further, should the finger be dirty, an unsanitary problem would be presented.

Accordingly, a pull-open type easy-open can lid for a container, having a push-open opening piece with a tab so as to exhibit a push open type function while the opening piece is not completely removed from the top plate of the container, with no risks of uncomfortable feeling and no unsanitary problem as mentioned above, has lately attracted considerable attention.

Cans of all kinds have been heretofore used as internally pressurized cans. However, a requirement for using them as internally depressurized cans has been more and more increased as they have been widely used.

A depressurized can tends to cause a rupture along a score line on the top plate of the can due to a water hammer phenomenon such that the top plate of the can which is concaved inwardly due to a pressure differential between the inside and outside of the can, is pressed outwardly by liquid in the can which is forced up when the can is dropped onto the ground. That is, the water hammer exerts a shearing stress on the score line thereby causing the top plate to rupture along the line so that the can is accidentally opened. This tendency has been notable in the case of cans having the above-mentioned so called nonseparable tab type lid which requires a small remaining thickness of the top plate of the can along a score line in order to decrease the force necessary for opening the lid as much as possible.

Further, since the top plate of an internally depressurized can is concaved inwardly, the tab makes close contact with the top plate of the can, and accordingly, it is hard to pick and pull up the tab.

Japanese Utility Model Examined Publication No. 62-23316 discloses a can lid in which deep and shallow recesses are formed on the top plate of a can underneath the nose of a tab. When the front and part of the tab nose which is rectangular depresses an opening piece, one of the corners of the rectangular end part of the tab nose enters into the deep recess without making contact with the top plate while the other corner enters into the shallow recess, thereby it is possible to easily pick and pull up the tab to some extent. However, upon the lid being opened by a depression force, when the other corner of the rectangular end part of the tab abuts against the bottom of the shallow recess so as to depress the same, the stopped part between the deep and shallow recesses is deformed until the bottom of the shallow recess approaches that of the deep recess, and thereafter, the depression force acts at length as a force for rupturing the score line. That is, a part of the depression force is inevitably consumed for deformation of the recesses so as to offer such a drawback that an extra force is required for opening the lid. Further, since the force application point, the fulcrum point and the acting point are not on one and the same straight line, the depression force cannot be concentrated.

As mentioned above, the conventional non-separable tab type can lid which is a pull-open type, incorporating an opening piece having a push-open type function has offered such a drawback that it has less drop-proof strength and it is difficult to be opened.

BRIEF SUMMARY OF THE INVENTION

The present invention is devised in order to eliminate the above-mentioned drawbacks inherent in the prior art, and accordingly one object of the present invention is to provide an easy-open can lid which has a sufficient drop-proof strength even though it is used for an internally depressurized can while ensuring a gap between the nose part of the tab and the top plate of the can so as to facilitate the pull-up of the tab, and which can concentrate a depression force exerted through the tab nose, to an opening piece, thereby making it possible to open the can lid with a small force.

Further, the other object of the present invention is to provide such an arrangement that a human finger can securely catch the lower surface of a finger hook part of the tab in order to facilitate initial rupture upon opening the lid.

According to the first aspect of the present invention, there is provided an easy-open can lid comprising a tab having an arcuate semicircular tab nose coupled to a substantially center part of the top plate of a can by a rivet, a score formed in the top plate of the can having a start point and an end point which are located in front of the rivet with a space therebetween, and an opening piece surrounded by the score, the space serving as a hinge for the opening piece, and the opening piece being adapted to be pushed down by the tab nose so as to open the can lid, wherein a tab nose recess, having a smooth bottom surface with no step part, for receiving therein the tab nose is formed in the top plate of the can underneath the tab nose and along the score on the rivet side.

In one specific form of the present invention, the bottom surface of the tab nose recess is flat.

In another specific form of the present invention, the bottom surface of the tab nose recess is inclined.

Further, in another specific form of the present invention, the bottom of the tab nose recess is an inverted conical inclined surface defined by a plurality of inclined surfaces, having a lowest part with which the tab nose is adapted to make contact.

Further, in another specific form of the present invention, the tab nose recess is a semicircular recess having an arcuate front end.

Further, in another specific form of the present invention, a narrow buffer zone is provided in the tab nose recess between a part of its outer peripheral edge on the rivet side and a part of the score near the rivet.

Further, in another specific form of the present invention, the buffer zone has a width of 0.5 to 5 mm.

Further, in another specific form of the present invention, both start and end points of the score are located on one and the same side of the rivet in front of the latter with the hinge space being formed therebetween.

Further, in another specific form of the present invention, concave and convex beads are formed in the opening piece surrounded by the score.

Further, in another specific form of the present invention, a tab pinch part having one end part which is slightly curved upward is provided to one end part of the tab on the side remote from the tab nose.

Further, in another specific form of the present invention, a tab pinch recess is formed in the top plate of a can underneath the tab pinch part.

According to the second aspect of the present invention, there is provided a method of manufacturing an easy-open can lid, comprising the steps of; coupling a tab having an arcuate semicircular tab nose to a substantially center part of the top plate of a can by a rivet, locating start and end points of a score line on the top plate in front of the rivet with a space serving as a hinge therebetween, forming the score by coining, and forming a tab nose recess having a smooth bottom surface with no step part on the top plate surrounded by the score and along a part of the score on the rivet side.

In one specific form of the second aspect of the present invention, a narrow buffer zone is formed in the tab nose recess between a part of its outer peripheral edge on the rivet side and a part of the score near the rivet.

Upon opening a pull-open type can lid, initial rupture is given to a score line in the vicinity of a rivet by raising a tab. Then, by pulling up the tab, the tab nose presses an opening piece downward so as to progress the rupture along the score. However, should the opening piece be not rigid so as to be easily bent, or should the depression force for the tab not be concentrated, the depression force may not be sufficiently great so that no rupture along the score occurs. Further, since a sufficient force is required for raising the tab, the tab should be sufficiently caught by the human finger. In particular, in the case of a depressurized can, since the top plate thereof is concaved inward, one end of the tab tends to make close contact with the top plate so that a human finger cannot smoothly catch the tab. Further, with a rectangular tab nose, the depression force cannot be sufficiently concentrated.

The first feature of the present invention is the provision of the tab nose having its tip end which is arcuate or semicircular. With this arrangement, since the opening piece is pressed by the arcuate tip end, a force application point, a fulcrum point and an acting point can be set on one straight line, and accordingly, the depression force can be concentrated so as to effect strong depression force. On the other hand, with a rectangular tab nose, the depression force would be dispersed so that no sufficient force can be applied to the opening piece. Even though one corner of the rectangular tab nose is brought into contact with the top plate, the corner of the tab nose which makes contact with the top plate is shifted from a line connecting the force application point and the fulcrum point so as to be unreasonable in the structure point of view, and accordingly, the depression force cannot be concentrated sufficiently. According to the present invention, the bottom surface of the recess which is distant from the start and end points of the score is pressed downward, and therefore it is possible to prevent such a risk that the hinge part between the start and end points of the score is broken. Further, the arcuate tip of the tab nose can increase its rigidity, and accordingly, it is possible to prevent the tab nose from being bent.

The second feature of the present invention is the provision of the semicircular tab nose recess formed in the top plate of a can and having a smooth bottom surface with no step part, for receiving the tab nose when the tab pinch part is pulled up.

If the tab nose can be lowered upon pulling up the tab pinch part, a human finger can easily catch the pull-up end thereof, and accordingly, a sufficient pull-up force can be applied thereto. With the provision of the semicircular recess for receiving the tab nose in the top plate, the tab pinch part can be pulled up until the arcuate tip of the tab nose abuts against the bottom of the recess.

The third feature of the present invention is the provision of the tab nose recess having a smooth bottom surface with no step part. From the study made by the applicants, it is found that should a step part exist on the bottom surface of the tab nose recess, a depression force through the tab nose which is pushed down would be absorbed by deformation of the step part since the step part is deformed largely, and accordingly, no actual depression force for rupturing the score is effected until the step part is eliminated. Accordingly, since a part of the applied force is not used for opening the can lid, a larger force is required for opening the can lid.

Thus, it is clear that no step part should be formed on the bottom surface of the tab nose recess. The bottom surface of the tab nose recess may be flat or inclined. Further, in the case of a plurality of inclined surfaces defining the tab nose recess, it is preferable to allow the tip of the nose part to make contact with the lowest part of the recess since this part is most effective to serve as the acting point at which the depression force can be concentrated.

The fourth feature of the present invention is the provision of the tab nose recess which can prevent the score from being ruptured due to the water hammer phenomenon which is caused when the can is dropped. The liquid contents in the can jumps up within the can when the can is dropped onto the ground, and pressurizes the can so as to give rise to the so-called water hammer phenomenon which applies a shock to the can lid. The coining process of forming a score line in the can lid drives metal toward both sides of the score so that the metal plate surrounded by the score is remarkably bulged out by the metal which has been driven away by coining the score so as to give rise to the so-called redundant metal phenomenon. It is found from the study made by the applicants that such redundant metal largely expands outward under the water hammer phenomenon when the can is dropped onto the ground, and this expansion exerts a large shearing stress on the score line which is thereby ruptured so that the can lid is accidentally opened. This phenomena is the so called "water-hammer phenomena".

This problem is particularly serious in the non-separable tab type can lid since the remaining thickness of the top plate of the can along the score is inevitably thin in order to reduce the force required for opening the can lid so that the mechanical strength of the can lid tends to be small. Thus, the rupture of the score in the can lid of a depressureized can is notable when the can is dropped with the can lid facing downward.

After several kinds of studies made by the applicants, it has been found that accidental opening of a can cannot be prevented unless the redundant metal phenomenon is eliminated.

The provision of the tab nose recess according to the present invention can absorb redundant metal build up during formation of the score or the like so that no redundant metal is present in the can lid, and accordingly, the expansion of the can upon dropping of the can onto the ground can be reduced, thereby it is possible to prevent the score from being ruptured. Further, since the tab nose recess having a smooth bottom surface with no step part is formed along a part of the score on the rivet side where rupture of the score is most likely to occur, it is possible to prevent rupture of the score.

It will be clear from the results of the comparison tests which will be explained hereinbelow that the above-mentioned can lid disclosed in the Japanese Utility Model Publication No. 63-23316, and having the bottom surface of the recess with a step part, cannot eliminate the redundant metal phenomenon so that the can would be accidentally opened by a shock under the water hammer phenomenon.

The fifth feature of the present invention is the provision of the tab nose recess which is formed in the top plate of the can within the part surrounded by the score, corresponding to the opening piece, and accordingly, the opening piece has a certain rigidity which can prevent hindrance to breakage of the score, the hindrance being caused by deformation of the opening piece by depression of the tab nose and absorbing the depression force.

The sixth feature of the present invention is the provision of the buffer zone between the recess having the smooth bottom surface with no step, and a part of the score near the rivet.

As mentioned above, the tab nose recess can prevent the score from being accidentally ruptured by the water hammer and can manage the concentration of the depression force by the tab nose for obtaining an effective can opening force.

From the study made by the applicant, it has been found that should the score make contact with or be in the vicinity of the tab nose recess, the score would be accidentally ruptured by the water hammer. It has been found that the score ruptures of this kind are found with a high degree of possibility about the score between the rivet and the tab nose recess.

In order to solve this problem, the buffer zone is provided, according to the present invention, between a part of the peripheral edge of the recess and a part of the score on the rivet side, the width of the buffer zone being preferably from 0.5 to 5 mm, and in particular, most preferably from 1.5 to 2.5 mm.

Should the width of the buffer zone be smaller than that mentioned above, the score would be accidentally ruptured during formation of the score. Further, should the width of the buffer zone be larger than that, it is not possible to obtain a shock absorbing effect.

The seventh feature of the present invention is the provision of the end part of the tab pinch part which is slightly bent upward so as to be easily caught by a human finger when the tab pinch part is raised.

The eighth feature of the present invention is the provision of the tab pinch recess in the top plate of the can underneath the end part of the tab pinch part in the can lid.

Further, with the seventh and eighth features, as mentioned above, the human finger can easily catch the tab when the latter is raised, and accordingly, the opening of the can be easily made.

Further, the ninth feature of the present invention is the provision of the tab nose recess which is prepared after the score is formed.

If the above-mentioned score is formed in that order, redundant metal which is build up during formation of the score or the like by coining can be absorbed effectively. From the result of experiments made by the applicants, it has been found that the absorption of redundant metal is more effective in the case of the provision of the recess after formation of the score than in the case of the provision of the recess before the formation of the score.

It should be noted here that the present invention can effect excellent advantages as mentioned above.

The tab nose recess according to the present invention, which effect the above-mentioned excellent advantages, should not be deep since the constraint by the fulcrum point would decrease so that the can opening effect becomes less if it is excessively deep. Further, it should not be shallow since the can opening effect and the water hammer resistance becomes less if it is excessively shallow. The depth of the recess depends upon the length of the tab nose measured from the rivet. An effective advantage can be found if the length of the nose from the rivet is in a range 7 to 9 mm while the depth of the recess is in a range of 0.2 to 1.0 mm. However, the depth of the recess is preferably in a range of 0.4 to 0.6 mm. Further, a most effective advantage can be obtained if the length of the nose from the rivet is 8 mm while the depth of the recess is 0.5 mm.

Further, the tab pinch recess occupies the extent of 10 mm in the outer peripheral direction from a position just below the tip of the tab pinch part while the depth of the tab pinch recess is preferably in the range of 0.2 to 1.0 mm. In this range, no interference with the tab occurs even though several cans are stacked one upon another, thereby it is possible to prevent the bottom of each can form being scratched.

Further, the scope of applicability of the present invention will become apparent from the detailed description and specific examples, while indicated preferred embodiments of the invention are given by way of illustration only since various changes and modification within the spirit and scope of the invention will become apparent to those skilled in the art from this detailed description.

BRIEF DESCRIPTION FOR THE DRAWING

These and other features and advantages of the invention may be more completely understood from the following detailed description of the preferred embodiments of the invention with reference to accompanying drawings in which.

DESCRIPTION OF THE PREFERRED EMBODIMENTS

Explanation will be hereinbelow made of preferred embodiments of the present invention with reference to the drawings.

Figure 1:
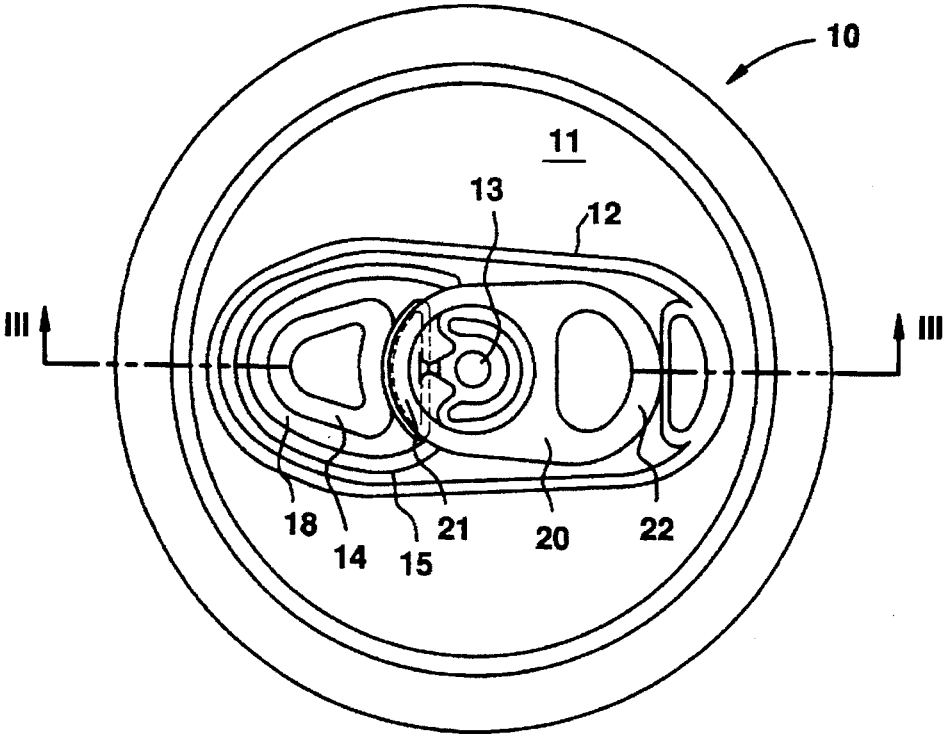
FIG. 1 is a plan view illustrating a can lid in one embodiment of the present invention.

FIG. 1 shows the front surface of the can lid in a first embodiment form of the present invention. In this figure, there is shown a can lid 10 in which a top plate recess 12 is formed being extended across the center of the top plate 11. Although this recess 12 gives a rigidity to the top plate 11, it is not always necessary. A tab 20 having a tab nose 21 is fixed to a substantial center of the top plate 11 by a rivet 13 within the recess 12. The tab nose 21 is in an arcuate or semicircular shape. A semicircular tab nose recess 19 having a smooth bottom surface with no step part is formed in the top plate 11 underneath the tab nose 21 and along a part of a score 15 on the rivet 13 side. The score 15 is extended along the periphery of the recess 12 from a position in front of the rivet 13, surrounding the tab nose recess 19 so as to define an opening piece 18. A bead 14 is formed on the opening piece in front of the tab nose recess 19 in order to increase the rigidity of the opening piece 18.

Figure 2:
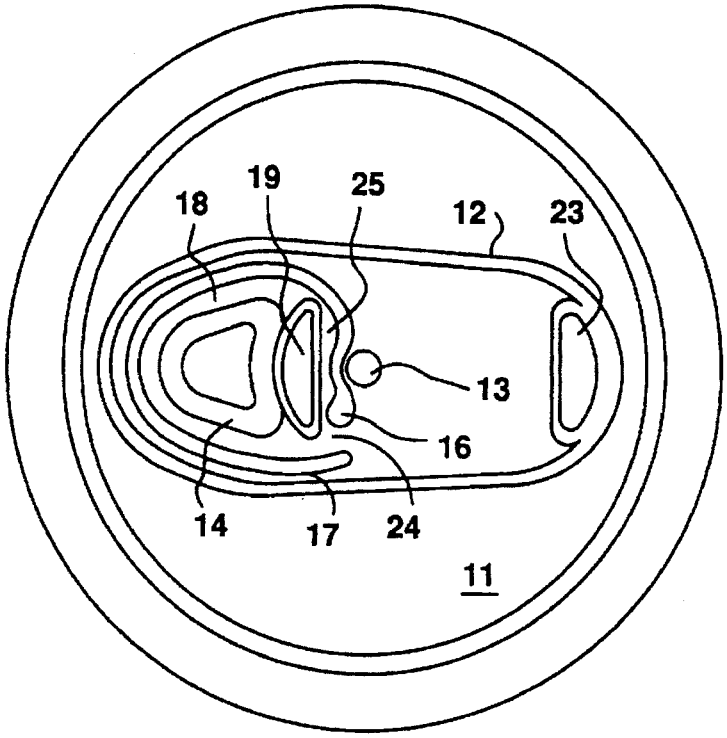
FIG. 2 is a rear view illustrating the can lid shown in FIG. 1.

Referring to FIG. 2 which shows the rear surface of the can lid shown in FIG. 1, it is clearly understood that the score extends from the point in front of the rivet 13, surrounding the opening piece 18 with substantially one complete loop. The score has a start point 16 and an end point 17. Even after the can lid is opened, the space between the start point 16 and the end point on the top plate 11 still remains without being cut so as to serve as a hinge 24 connecting the opening piece 18 to the top plate 11, that is, the space functions to prevent the opening piece from being separated from the can lid. Accordingly, the pollution caused by separated tabs which have been thrown away is prevented. Since the tab nose has an arcuate or semicircular shape so that a depression force can be concentrated to the front end thereof, and since the force concentrated point is distant from the hinge, the hinge is never broken. A tab pinch recess 23 is formed on the top plate 11 underneath a tab pinch part of the tab 20. Upon pulling up the tab 20, if a human finger is inserted in the tab pinch recess 23, it can easily catch the tab pinch part so as to facilitate the pull-up of the tab 20.

A buffer zone 25 is formed on the top plate 11 between a part of the score 15 near the rivet 13 and a part of the outer periphery of the recess 19 for absorbing a shock under the water hammer phenomenon, on the rivet side in order to prevent the score from being ruptured under the water hammer phenomenon.

Figure 3:
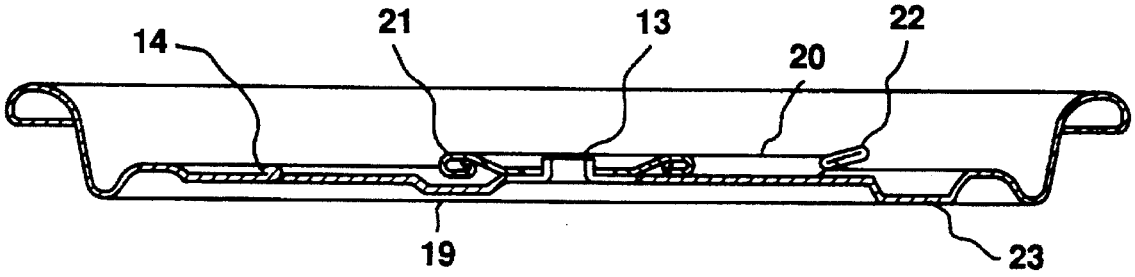
FIG. 3 is a sectional view along line III—III in FIG. 1.

Referring to FIG. 3 which is a sectional view along line III—III in FIG. 1, it is understood that the tab nose recess 19 has a smooth bottom surface with no step part. Since no step part is present, the tab nose 21 directly presses the bottom surface when the opening piece 18 is depressed, and accordingly, the depression force can be used in its entirety for opening the can. Should a step part be present, the depression force would be absorbed through deformation of the step part which decreases the rigidity of the opening piece, as mentioned above, and accordingly, the force used for opening the can is decreased, and accordingly, such a disadvantage that a large force and extra time are required for opening the can.

Further, since one part of the tab pinch part is slightly raised upward and since the tab pinch recess 23 is formed on the top plate 11 below the pinch part of the tab, a human finger can be easily inserted below the tab pinch part.

With this arrangement in which the end part of the tab pinch part is raised and the tab pinch recess is formed below the tab pinch part, there can be offered such an advantage that the tab pinch part can be satisfactorily caught by a human finger, and accordingly, the tab can be easily pulled up.

In view of the forgoing, according to the present invention, a rupturing force directly acts upon the opening piece from the front end of the tab so that the score is ruptured appropriately. Since the opening end piece has a large rigidity and is not bent, the opening of the can be facilitated. Further, since the tab nose never abuts against the hinge between the start point and the end point of the score, no depression force is exerted to the hinge which is therefore not broken. Further, there is obtained the excellent advantage that pull-up of the tab can he facilitated.

Figure 4:
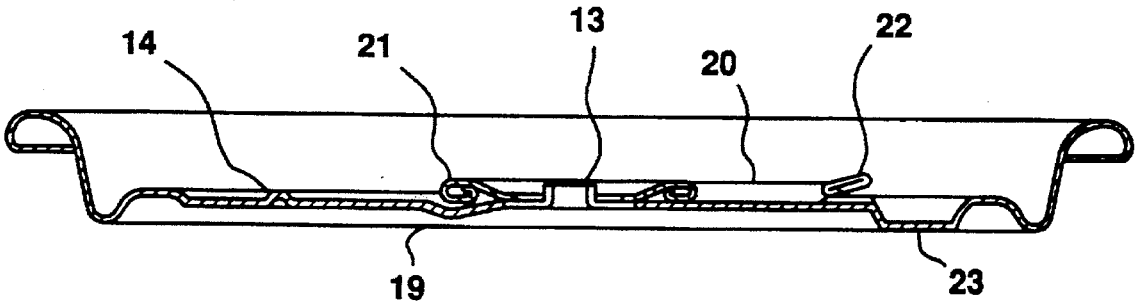
FIG. 4 is a sectional view illustrating a can lid in another embodiment of the present invention.

Referring to FIG. 4 this is a sectional view illustrating a can lid in another embodiment of the present invention. In this embodiment, the bottom surface of the nose recess for receiving the tab nose is inclined. Further, also in this embodiment, no step part is presented in the bottom surface of the recess.

In order to clearly understand the technical effects and advantages of the present invention, comparison tests were carried out with the use of conventional can lids as examples to be compared with those according to the present invention, which will be explained hereinbelow.

Figure 5:
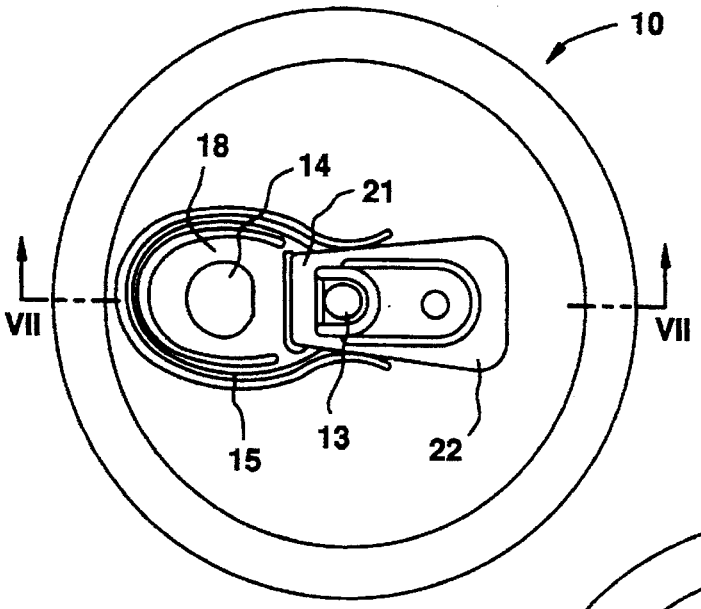
FIG.5 PRIOR ART
FIGS. 5 and 6 are plan and rear views, respectively, illustrating a conventional can lid.
Figure 6:
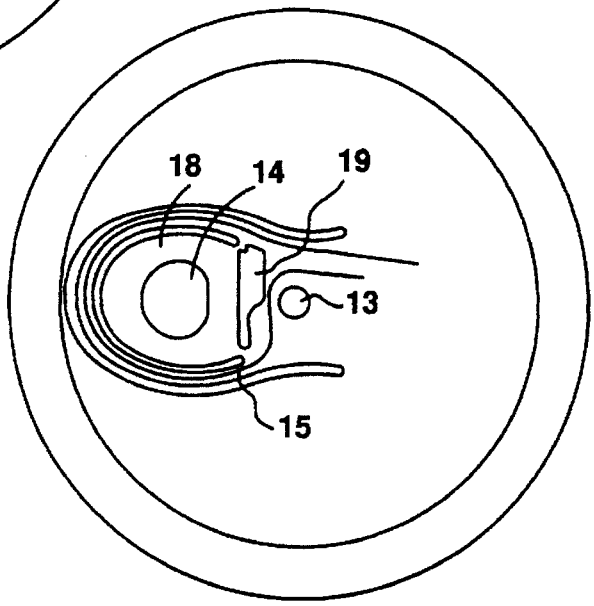
FIG.6 PRIOR ART
Figure 7:
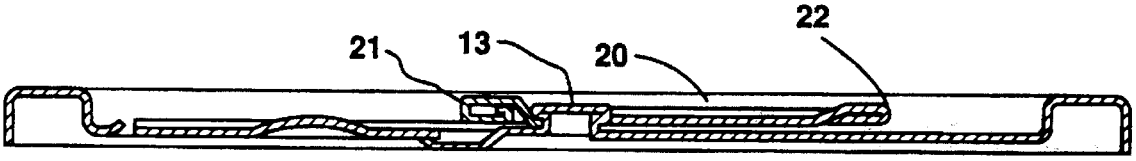
FIG.7 PRIOR ART
FIG. 7 is a sectional view illustrating line VII—VII in FIG. 5.
Figure 8:
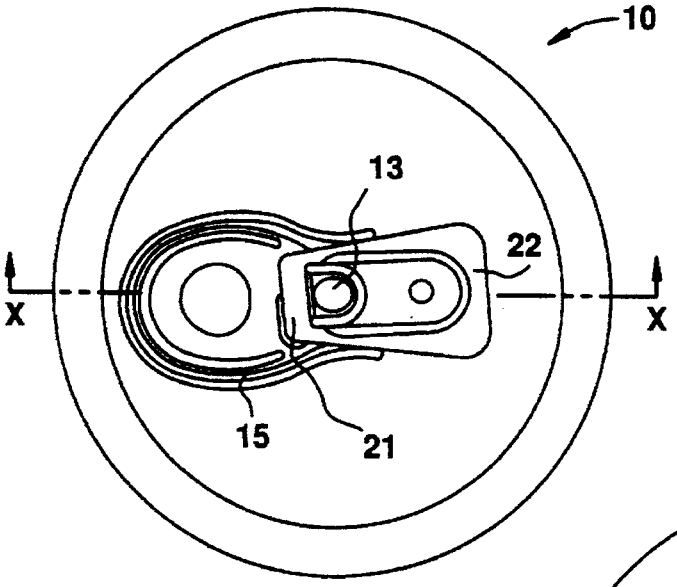
FIG.8 PRIOR ART
FIGS. 8 and 9 are plan and rear views, respectively, illustrating another conventional can lid.
Figure 9:
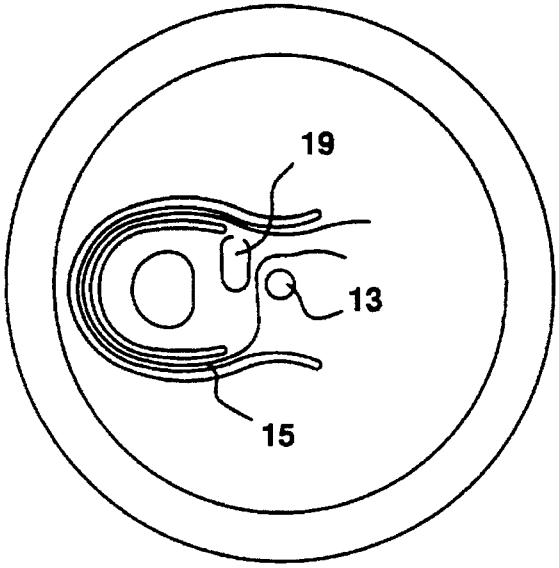
FIG.9 PRIOR ART
Figure 10:
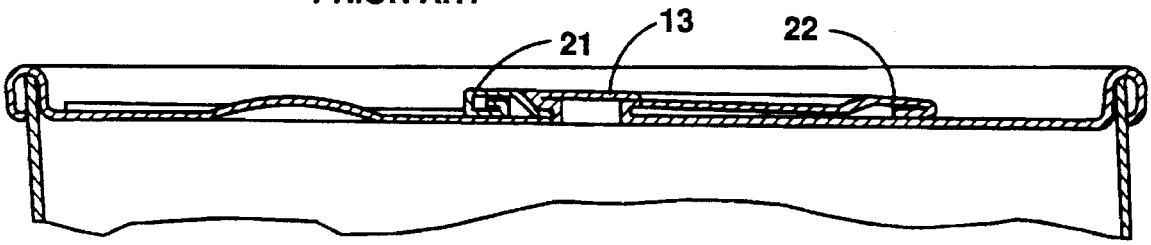
FIG.10 PRIOR ART
FIG. 10 is a sectional view along line X—X in FIG. 8.

FIGS. 5 to 7 show a conventional can lid disclosed in Japanese Kokoku (examined) Utility Model Publication No. 63-233316, and FIGS. 8 to 10 show a can lid disclosed in Japanese Kokoku Patent Publication No. 57-42545. Both can lids were used for the comparison.

Referring to FIG. 5, a recess 19 is formed on the top plate of a can underneath one of the corners of a rectangular tab nose, and accordingly, this corner is received in the recess 19 so as to prevent the corner from making contact with the top plate when the can lid is opened. Further, a shallow recess is formed on the top plate adjacent to the recess which is adapted to receive the tab nose that is depressed, in order to prevent the tab pinch part from making close contact with the top plate. And thereby it is possible to facilitate the pull-up of the pinch part 22 of the tab. However, since the depression is carried out only with one of the corners of the rectangular tab nose, the force application point, the fulcrum point and the acting point do not fall on one and the same straight line. Accordingly, the depression force can not be concentrated. Further, in this conventional example, a step part which is formed between the shallow recess and the deep recess, absorbs the depression force upon opening of the can, there is presented such a disadvantage that a large force and a longer time are required for opening the can.

Referring to FIG. 8 which shows the can lid disclosed in the above-mentioned Japanese Patent Publication No. 57-42545, a recess 19 is formed on the top plate below one of the corners of the rectangular tab nose.

As clearly understood from FIG. 10, since the other one of the corners of the rectangular tab nose makes close contact with the top plate so that the pinch part 22 is made into close contact with the top plate, the pull-up of the pinch part 22 is difficult, and since the depression is made by one of corners of the rectangular nose plate so that the force application point, the fulcrum point and the acting point do not fall onto one and the same straight line, a sufficient depression force cannot be structurally exerted.

Further, as clearly understood from the comparison tests, not only the concentration of the depression force is less, but also redundant metal build-up cannot be absorbed so that the water hammer phenomenon cannot be effectively avoided since the area of the deep recess is small.

COMPARISON TEST 1

Water Hammer Resistance Test

A can lid in the first embodiment of the present invention, shown in FIGS. 1 to 3, was prepared, the depth of the tab nose recess being 0.5 mm while the can is made of steel, having a internal volume of 350 ml and a side wall thickness of 0.1 mm. Further, the top plate is made of aluminum, having a thickness of 0.3 mm. Further, the can lid has an outer diameter of 60 mm, and a remaining thickness of the top plate along the score is 120 μm.

A can lid as shown in FIGS. 5 to 7 was prepared as a comparison example 1. The depth of the deep recess is 0.6 mm while the depth of the shallow recess is 0.4 mm with the step part therebetween having a height of 0.2 mm. The can is made of steel, having an internal volume of 250 ml and a side wall thickness of 0.1 mm. The top plate is made of aluminum having a thickness of 0.3 mm. The diameter of the can lid is 60 mm, and the remaining thickness of the top plate along the score is 120 μm.

A can lid as shown in FIGS. 8 to 10 was prepared as a comparison example 2. The depth of the recess is 0.6 mm. This can has an internal volume of 350 ml and is made of steel, having a side wall thickness of 0.1 mm. The top plate is made of aluminum, having a thickness of 0.3 mm. Further, the can lid has an outer diameter of 60 mm, and the remaining thickness of the top plate along the score is 120 μm.

A can lid as the same as that for the first embodiment 1, except that no buffer zone is formed, was prepared as a comparison example 3. In this can lid, the outer peripheral edge of the recess 19 for absorbing the water hammer shock, makes contact, on the rivet side, with a part of the score near to the rivet.

Drop tests were carried out for one hundred cans which were filled with water. The inside of each of the cans to be tested was evacuated up to a vacuum degree of 40 cm Hg. The results of the test are shown in Table 1.

TABLE 1

| Numbers of Cans with Score Rupture | |
|---|---|
| Embodiment 1 | 0 |
| Comparison Example 1 | 56 |
| Comparison Example 2 | 78 |
| Comparison Example 3 | 81 |

Note:
In the tests, cans were dropped onto a wood floor with an upside-down orientation, from a height of 1 m. Further, a can having a bit of score rupture was counted as a ruptured can.

COMPARISON TEST 2

Can Opening Test

All cans for the first embodiment of the present invention, and as comparison examples which are the same as those used in the comparison test 1 were prepared. They were filled with pure water and were evacuated up to a vacuum degree of 40 cm Hg. In the tests, each can was fixed, and then the tab pinch part was pulled up so as to measure the force with which the rupture of the score is initiated. Further, the can opening chart was taken at the time of the rupture.

Figure 11:
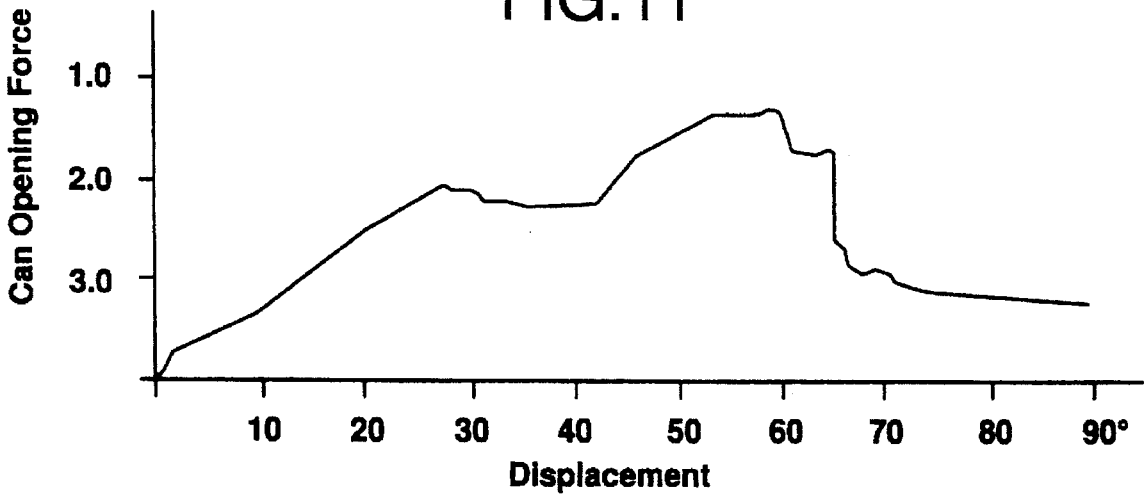
FIGS. 11 to 13 are charts showing the results of tests of can opening.
Figure 12:
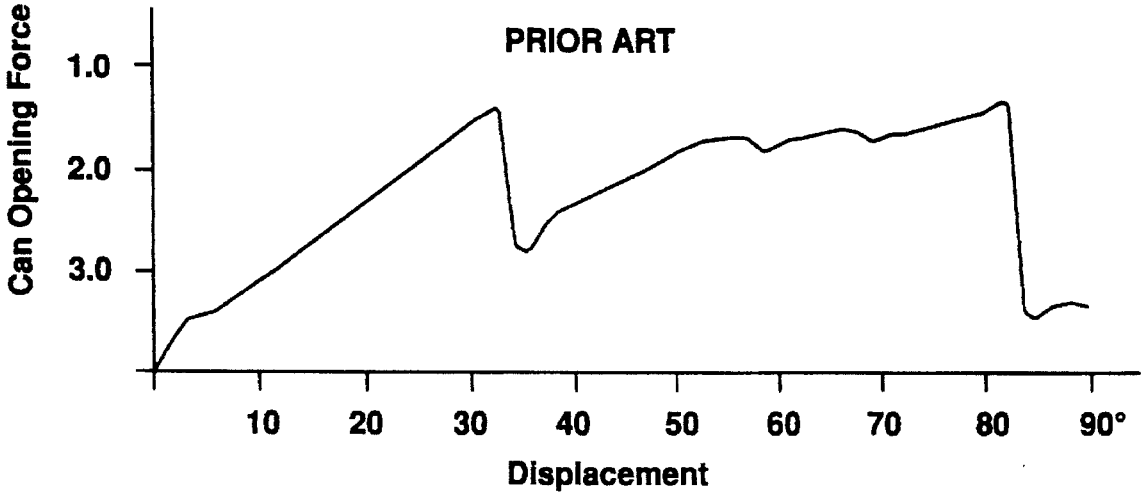
FIG.12 PRIOR ART
Figure 13:
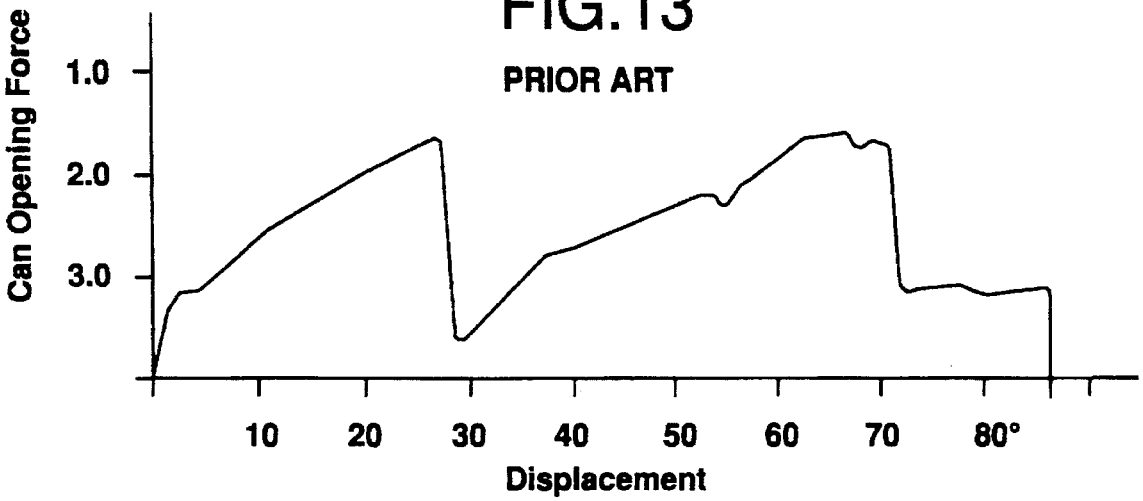
FIG.13 PRIOR ART

The results of these tests are shown in Table 2, and the can opening charts are shown in FIGS. 11 to 13 among which FIG. 11 shows the results of tests for the first embodiment, FIG. 12 show those for the comparison example 1 and FIG. 13 shows those for the comparison example 3.

TABLE 2

| Initial Can Opening Force (kgf) | |
|---|---|
| Embodiment 1 | 1.9 |
| Comparison Example | 2.4 |
| Comparison Example | 2.6 |
| Comparison Example | 2.2 |

Thus, according to the present invention, the can could be opened with a small force. However, with the comparison example 1, a force was required to eliminate the step part, and with the comparison example 2, it was difficult to pull-up the tab. The comparison example 1 and 2 required forces which are larger than that for the first embodiment by 26% and 37%, respectively.

EVALUATION

It is clearly understood from the above-mentioned comparison test that the can lid according to the present invention can be opened with a small force, and that no score rupture is caused under the water hammer phenomenon even though the can is dropped.

As mentioned above, the present invention offers excellent can opening ability and water hammer resistance by the combination of the several features, and further, provides easy and safe handling.

What we claim is:

1. A can lid comprising:

a top plate having a center which is a fulcrum point;

a tab having a tab nose at one end thereof and a force application point at another end of said tab and coupled substantially to the center of said top plate by a rivet, wherein the tab nose is arcuate;

a score formed in said top plate and having a start point and an end point with a hinge space therebetween in front of said rivet;

an opening piece surrounded by said score, said opening piece being adapted to be depressed by said arcuate tab nose so as to open said lid;

a semicircular tab nose recess formed in said opening piece underneath said arcuate tab nose and conforming in shape with said tab nose, the arcuate curve of said tab nose being engagable with the bottom of said semicircular tab nose recess, along a part of said score and having a smooth bottom surface with no step part, for receiving said arcuate tab nose and being pressed by the tab nose when said tab is pulled up, said force application point, fulcrum point and tab nose being in one straight line; and said tab nose recess having a straight side perpendicular to the straight line formed by said force application point, fulcrum point and tab nose opposite said semicircular curve.

2. The can lid as set forth in claim 1, wherein the bottom surface of said tab nose recess is flat.

3. The can lid as set forth in claim 1, wherein the bottom surface of said tab nose recess is inclinded.

4. The can lid as set forth in claim 1 said tab nose recess having an outer peripheral edge, wherein a buffer zone having a narrow width is formed between a part of the outer peripheral edge of said tab nose recess and a part of said score near said rivet.

5. The can lid as set forth in claim 4, wherein said buffer zone has a width in a range of 0.5 to 5 mm.

6. The can lid as set forth in claim 1 wherein the start point and the end point of said score are located on either one of left and right sides of said rivet in front thereof so as to define therebetween said hinge space.

7. The can lid as set forth in claim 1 wherein convex beads are formed on said opening piece surrounded by said score.

8. The can lid as set forth in claim 1 wherein said tab is provided, opposite from said tab nose, with a tab pinch part having an end part which is slightly bent upward.

9. The can lid as set forth in claim 8, wherein a tab pinch recess is formed on said top plate underneath said tab pinch part.

* * * * *